US011361785B2

(12) United States Patent
Shim et al.

(10) Patent No.: US 11,361,785 B2
(45) Date of Patent: Jun. 14, 2022

(54) SOUND OUTPUTTING DEVICE INCLUDING PLURALITY OF MICROPHONES AND METHOD FOR PROCESSING SOUND SIGNAL USING PLURALITY OF MICROPHONES

(71) Applicant: Samsung Electronics Co., Ltd., Gyeonggi-do (KR)

(72) Inventors: Hwan Shim, Gyeonggi-do (KR); Kyuhan Kim, Gyeonggi-do (KR); Hangil Moon, Gyeonggi-do (KR); Gunwoo Lee, Gyeonggi-do (KR); Jaemo Yang, Gyeonggi-do (KR); Aran Cha, Gyeonggi-do (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 16/787,213

(22) Filed: Feb. 11, 2020

(65) Prior Publication Data

US 2020/0258539 A1 Aug. 13, 2020

(30) Foreign Application Priority Data

Feb. 12, 2019 (KR) ..... 10-2019-0016334

(51) Int. Cl.

| | |
|---|---|
| ***G10L 25/78*** | (2013.01) |
| ***H04R 1/10*** | (2006.01) |
| ***H04R 3/00*** | (2006.01) |

(52) U.S. Cl.

CPC ..... *G10L 25/78* (2013.01); *H04R 1/1016* (2013.01); *H04R 1/1083* (2013.01); *H04R 3/005* (2013.01); *H04R 2410/05* (2013.01)

(58) Field of Classification Search

CPC . G10L 25/78; G10L 21/0208; G10L 21/0216; G10L 25/90; G10L 2021/02165;

(Continued)

(56) References Cited

U.S. PATENT DOCUMENTS 7,773,759 B2 8/2010 Alves et al.
7,817,808 B2 10/2010 Konchitsky et al.

(Continued)

FOREIGN PATENT DOCUMENTS

EP 2882203 A1 10/2015
JP 2011-147103 A 7/2011

(Continued)

OTHER PUBLICATIONS

International Search Report dated Jun. 9, 2020.
European Search Report dated Feb. 17, 2022.

*Primary Examiner* — Yogeshkumar Patel
(74) *Attorney, Agent, or Firm* — Cha & Reiter, LLC

(57) ABSTRACT

An electronic device and method are disclosed. The electronic device includes a first microphone, a second microphone, a memory; and a processor. The processor implements the method, including: determining whether a voice is detected in a first sound signal detected by the first microphone; determine whether a present recording period is a voice period or a silent period based on the determination, when the present period is the silent period, receive a second sound signal via the second microphone and analyze a noise signal included therein, remove noise signals from one of the first and second sound signals, based on characteristics of the voice period or the analyzed noise signal, and combine the first and second sound signal into an output signal and transmit the output signal to an external device.

18 Claims, 10 Drawing Sheets

(58) Field of Classification Search
CPC ..... G10L 2021/02082; H04R 1/1083; H04R 1/1016; H04R 3/005; H04R 2410/05; H04R 1/1025; H04R 2410/01; H04R 2499/11; H04R 3/02
See application file for complete search history.

(56) References Cited

U.S. PATENT DOCUMENTS

| | | | | |
|---|---|---|---|---|
| 8,081,780 | B2 | 12/2011 | Goldstein et al. | |
| 8,477,973 | B2 | 7/2013 | Merks | |
| 8,494,174 | B2 | 7/2013 | Konchitsky | |
| 8,867,773 | B2 | 10/2014 | Kimura et al. | |
| 8,953,812 | B2 | 2/2015 | Konchitsky | |
| 9,094,766 | B2 | 7/2015 | Merks | |
| 9,219,964 | B2 | 12/2015 | Merks | |
| 9,398,366 | B2 | 7/2016 | Gleissner | |
| 9,473,850 | B2 | 10/2016 | Konchitsky | |
| 9,491,543 | B1 | 11/2016 | Konchitsky | |
| 9,699,573 | B2 | 7/2017 | Merks | |
| 9,712,926 | B2 | 7/2017 | Merks | |
| 9,736,578 | B2 | 8/2017 | Iyengar et al. | |
| 10,171,922 | B2 | 1/2019 | Merks | |
| 10,225,668 | B2 | 3/2019 | Merks | |
| 10,715,931 | B2 | 7/2020 | Merks | |
| 2009/0016541 | A1 | 1/2009 | Goldstein et al. | |
| 2011/0135106 | A1* | 6/2011 | Yehuday | H04R 3/005 381/71.6 |
| 2012/0257779 | A1* | 10/2012 | Kimura | H04R 3/00 381/359 |
| 2013/0073283 | A1* | 3/2013 | Yamabe | G10L 21/0216 704/226 |
| 2013/0301844 | A1 | 11/2013 | Konchitsky | |
| 2014/0185819 | A1 | 7/2014 | Gleissner | |
| 2015/0163602 | A1 | 6/2015 | Pedersen et al. | |
| 2016/0029131 | A1 | 1/2016 | Merks | |
| 2016/0360314 | A1 | 12/2016 | Iyengar et al. | |
| 2017/0311068 | A1 | 10/2017 | Shin | |
| 2019/0043518 | A1 | 2/2019 | Li | |
| 2019/0297435 | A1 | 9/2019 | Pedersen et al. | |
| 2020/0396550 | A1 | 12/2020 | Pedersen et al. | |

FOREIGN PATENT DOCUMENTS

| | | | | |
|---|---|---|---|---|
| JP | 2012-168212 | A | 9/2012 | |
| KR | 10-1381289 | B1 | 4/2014 | |
| KR | 10-2017-0121545 | A | 11/2017 | |
| WO | WO-2016050298 | A1 * | 4/2016 | H04S 3/002 |
| WO | 2017-147428 | A1 | 8/2017 | |

* cited by examiner

SOUND OUTPUTTING DEVICE INCLUDING PLURALITY OF MICROPHONES AND METHOD FOR PROCESSING SOUND SIGNAL USING PLURALITY OF MICROPHONES

CROSS-REFERENCE TO RELATED APPLICATION(S)

This application is based on and claims priority under 35 U.S.C. § 119 to Korean Patent Application No. 10-2019-0016334, filed on Feb. 12, 2019, in the Korean Intellectual Property Office, the disclosure of which is incorporated by reference herein its entirety.

BACKGROUND

1. Field

Certain embodiments disclosed in the disclosure relate to a sound outputting device including a plurality of microphones and a method for processing a sound signal using a plurality of microphones.

2. Description of Related Art

A variety of sound outputting devices (e.g., earbuds, earphones, and headsets) are now available for use with portable electronic devices, such as smartphones and tablets. The sound outputting device may be wirelessly paired with mobile devices via short-range wireless communication, or may be physically connected to the mobile device using a wired communication (e.g., through a headphone jack). Recently, a particular type of lightweight ear set has been developed that can be seated on a user by partial insertion into the ear canal of the user.

The above information is presented as background information only to assist with an understanding of the disclosure. No determination has been made, and no assertion is made, as to whether any of the above might be applicable as prior art with regard to the disclosure.

SUMMARY

A sound outputting device may be equipped with two microphones. A first microphone may be disposed outside the housing of the device, and the second may be disposed inside the housing of the device. The microphone disposed within the housing may in some cases be used to record a voice of a user in a high noise level environment. The microphone disposed outside the housing may be used to record in an environment having low or normal levels of ambient noise. By setting stored noise thresholds for the ambient noise level, the sound outputting device may switch between the microphones, so that the appropriate microphone is utilized depending on the levels of ambient noise in the given environment.

Further, when the sound outputting device uses the microphone inside the housing, the sound outputting device may alter a frequency of the recorded voice of the user in order to compensate for sound degradation during recording (e.g., caused by, for example, interference with the housing). In this case, the sound outputting device may execute a simple frequency conversion. However, oftentimes the adjustment is insufficient and the recorded voice is distorted. Thus, the sound outputting device often fails to sufficient adjust recording parameters to account for ambient noise in the environment.

Aspects of the disclosure are to address at least the above-mentioned problems and/or disadvantages and to provide at least the advantages described below.

In accordance with an aspect of the disclosure, a sound outputting device may include a first microphone disposed to face a first direction, a second microphone disposed to face a second direction, a memory storing instructions, and a processor, wherein the instructions are executable by the processor to cause the electronic device to: determine whether a voice is detected in a first sound signal received via the first microphone, when the voice is detected, determine that a present recording period is a voice period, and when the voice is undetected, determine that the present recording period is a silent period, when the present period is the silent period, receive a second sound signal via the second microphone and detect characteristics of an external noise signal included in the second sound signal, based at least on the detected characteristics, remove noise signals from one of the first sound signal and the second sound signal, based on characteristics of the voice period or the characteristics of the external noise signal, and combine the first sound signal and the second sound signal into an output signal and transmit the output signal to an external device.

In accordance with an aspect of this disclosure, a method for an electronic device is disclosed, including: determining by a processor whether a voice is detected in a first sound signal received via a first microphone, when the voice is detected, determining that a present recording period is a voice period, and when the voice is undetected, determining that the present recording period is a silent period, when the present period is the silent period, receiving a second sound signal via a second microphone and detect characteristics of an external noise signal included in the second sound signal, based at least on the detected characteristics, removing noise signals from one of the first sound signal and the second sound signal, based on characteristics of the voice period or the characteristics of the external noise signal, and combining the first sound signal and the second sound signal into an output signal and transmit the output signal to an external device.

Other aspects, advantages, and salient features of the disclosure will become apparent to those skilled in the art from the following detailed description, which, taken in conjunction with the annexed drawings, discloses certain embodiments of the disclosure.

BRIEF DESCRIPTION OF THE DRAWINGS

The above and other aspects, features, and advantages of certain embodiments of the disclosure will be more apparent from the following description taken in conjunction with the accompanying drawings, in which.

In connection with illustrations of the drawings, the same or similar reference numerals may be used for the same or similar components.

DETAILED DESCRIPTION

Hereinafter, certain embodiments of the disclosure are described with reference to the accompanying drawings.

Figure 1:
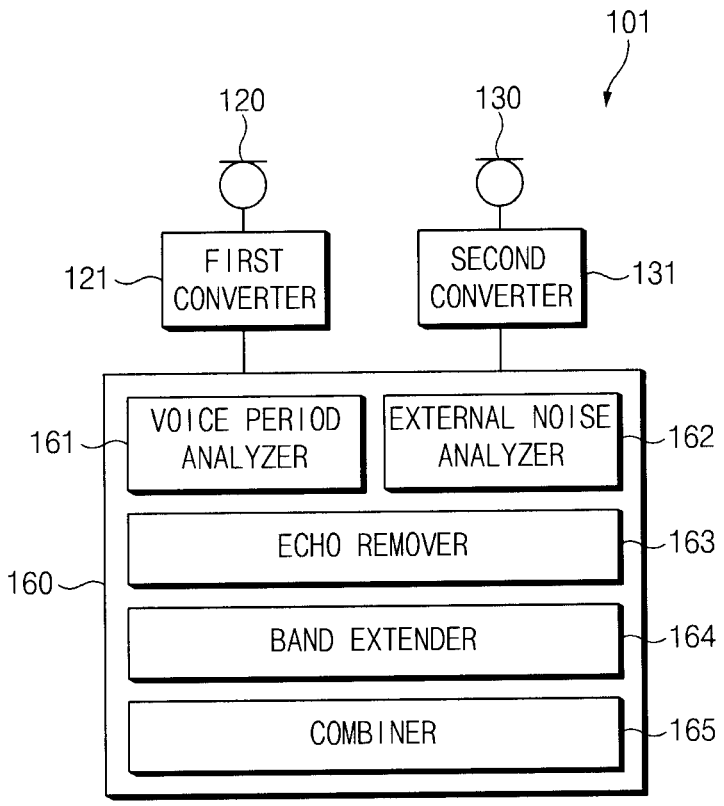
FIG. 1 is a block diagram of a sound outputting device according to certain embodiments.

FIG. 1 is a block diagram of a sound outputting device according to certain embodiments. FIG. 1 illustrates a configuration related to sound outputting, but the disclosure is not limited thereto.

Referring to FIG. 1, a sound outputting device 101 may include a first microphone 120, a second microphone 130, a first converter 121, a second converter 131, and a processor 160.

The first microphone 120 may be positioned to face in a first direction of the sound outputting device 101 to receive a first sound signal. The first direction may be a direction toward an inner ear space of a user or a direction facing toward the user's body when the user attaches the sound outputting device 101 to the ear.

According to certain embodiments, the first sound signal received via the first microphone 120 may be delivered to the processor 160 via the first converter (e.g., an analog-to-digital converter or "ADC" 121). For example, the first converter 121 may convert an analog signal received via the first microphone 120 into a digital signal.

The second microphone 130 may be positioned to face in a second direction of the sound outputting device 101 to receive a second sound signal. The second direction may be a different direction (e.g., an opposite direction to) from the first direction in which the first microphone 120 is mounted. The second direction may be a direction in which the sound outputting device 101 is exposed to an outside when the user wears the sound outputting device 101 on the ear. The second microphone 130 may receive a sound that originates from an outside of the sound outputting device 101.

According to certain embodiments, the second sound signal received via the second microphone 130 may be delivered to the processor 160 via the second converter (e.g., ADC 131). The second converter 131 may convert an analog signal received via the second microphone 130 to a digital signal.

The processor 160 may process the signals received via the first microphone 120 and the second microphone 130. According to certain embodiments, the processor 160 may include a voice period analyzer 161, an external noise analyzer 162, an echo remover 163, a band extender 164, and a combiner 165.

The voice period analyzer 161 may determine a voice period based on the first sound signal received by the first microphone 120. For example, the voice period analyzer 161 may distinguish the voice period using a VAD (voice activity detection) scheme or an SPP (speech presence probability) scheme. According to an embodiment, the voice period analyzer 161 may classify the voice period as a silent period, an only-speaking period, an only-listening period, or a cross-talk period. For example, the voice period analyzer 161 may compare a waveform, a magnitude, or a frequency component of the first sound signal with a pre-stored voice pattern of each period and may classify the voice period as the only-speaking period, the only-listening period, or the cross-talk period based on the comparison result. When there is no matching voice pattern, the voice period analyzer 161 may determine a current period as the silent period.

The external noise analyzer 162 may analyze an external noise signal around the user (or around the sound outputting device 101) based on the second sound signal received via the second microphone 130. According to an embodiment, the external noise analyzer 162 may determine characteristics of the external noise signal based on the second sound signal received during the silent period determined by the voice period analyzer 161. The silent period may refer to a period for which a voice signal of a user (hereinafter, referred to as a first speaker) using the sound outputting device 101 or a voice signal of a counterpart speaker (hereinafter, referred to as a second speaker) is not generated.

For example, the external noise analyzer 162 may classify a type of the external noise signal (e.g., non-stationary/stationary), and analyze characteristics (e.g., babble, wind, café noise).

The echo remover 163 may remove an echo signal from the first sound signal received by the first microphone 120 or the second sound signal received by the second microphone 130. The echo signal may occur when not a voice signal of the first speaker of the sound outputting device 101 but a voice signal of the second speaker is output through a speaker of the sound outputting device 101 and then flows back into the first microphone 120 or the second microphone 130.

According to an embodiment, the echo remover 163 may include a first echo remover for removing an echo signal included in the first sound signal, and a second echo remover for removing an echo signal included in the second sound signal.

The band extender 164 may extend a band of the first sound signal received via the first microphone 120. The first sound signal received via the first microphone 120 may include a signal resulting from a voice of the first speaker transmitted through an inner ear space (e.g., an external auditory meatus) of the user. The first sound signal may have characteristics in which a sound pitch band is limited to a low pitch band (e.g., 4 kHz or lower). The band extender 164 may perform band extension on the first sound signal to partially correct a tone color. For example, the band extender 164 may perform the band extension on the first sound signal of 4 kHz or lower to convert the first sound signal into a signal of 8 kHz or lower to have a natural tone color.

According to certain embodiments, the processor 160 may further include an equalizer (not shown) that increases a power of a specified band. For example, the equalizer may emphasize a size of a frequency band of 1.5 kHz to 2.5 kHz or greater, so that a sufficient signal may be secured during the band extension of the first sound signal.

The combiner 165 may combine a signal (hereinafter, a first converted signal) to which the first sound signal received via the first microphone 120 is converted with a signal (hereinafter, a second converted signal) to which the second sound signal received via the second microphone 130 is converted. For example, the first converted signal may be obtained by removing an echo signal and a noise signal from the first sound signal to obtain a filtered signal and then by performing band extending of the filtered signal. The second converted signal may be obtained by removing an echo signal and a noise signal from the second sound signal. According to an embodiment, the combiner 165 may change a combining scheme (e.g., a combining ratio) between the first converted signal and the second converted signal based on an ambient noise condition. For example, in a high noise level environment, the combiner 165 may increase a percentage of the first converted signal and lower a percentage of the second converted signal.

FIG. 1 is a block diagram of the sound outputting device 101, such that each block corresponds to each function. However, the disclosure is not limited thereto. Some components may be added or omitted. Some components may be integrated with each other.

According to certain embodiments, the sound outputting device 101 may further include a memory (not shown). The memory may store instructions therein. An operation of the processor 160 according to certain embodiments may be configured via execution of the instructions.

Figure 2:
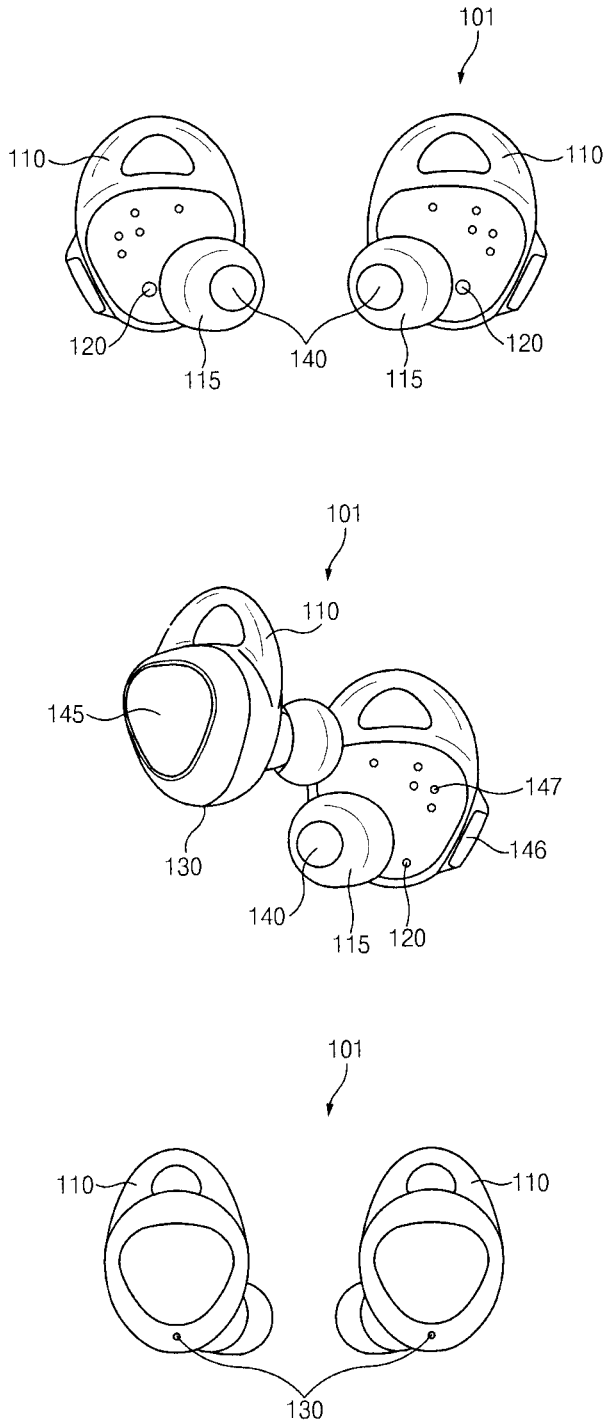
FIG. 2 shows an appearance of an sound outputting device according to certain embodiments.

FIG. 2 shows an appearance of a sound outputting device according to certain embodiments. The sound outputting device 101 may be implemented using two or more devices that are symmetrical to each other. In this case, each device may be equipped with two or more microphones.

Referring to FIG. 2, the sound outputting device 101 may include a housing 110, the first microphone 120, the second microphone 130, a speaker 140, a manipulator 145, a sensor 146, and a charging terminal 147. FIG. 2 shows an example of the sound outputting device 101 in a form of an ear set, but the disclosure is not limited thereto. For example, the sound outputting device 101 may be configured as a headset which is worn over a head of the user.

On the housing 110, the first microphone 120, the second microphone 130, the speaker 140, the manipulator 145, the sensor 146, and the charging terminal 147 may be mounted. The housing 110 may receive various components (e.g., the processor, the memory, a communication circuit, and a printed circuit board) utilized for the operation of the sound outputting device 101 therein.

According to an embodiment, a portion of the housing 110 may include an ear-tip 115 inserted into an inner ear space of the user. The ear-tip 115 may protrude outwardly from the body of the housing 110. The ear-tip 115 may communicably couple with the speaker 140 through which a sound is output (e.g., providing a channel for which sound can travel through the tip and into the ear). The ear-tip 115 may be inserted into the ear canal of the user for use.

The first microphone 120 may be positioned in the housing 110 to face in the first direction. The first direction may be a direction toward the inner ear space of the user or a direction in which the first microphone 120 faces the user's body when the sound outputting device 101 is worn on the user. For example, the first microphone 120 may be a bone conduction microphone positioned at a point where the microphone may contact the user's skin.

According to an embodiment, the first microphone 120 may be disposed to be adjacent to the ear-tip 115. When the ear-tip 115 is inserted into the inner ear space of the user, the first microphone 120 may detect a sound transmitted through an inner ear tube of the user, or by a vibration transmitted through the body of the user (e.g., by the bone conduction through the jaw bone or other portions of the skull).

The second microphone 130 may be positioned in the housing 110 to face in the second direction. The second direction may be a different direction (e.g., an opposite direction to) from the first direction in which the first microphone 120 is mounted. For example, the second direction may face outwardly when the sound outputting device 101 is worn on the user. The second microphone 130 may primarily receive a sound from an outside of the user. According to an embodiment, the second microphone 130 may be positioned near the user's mouth when the sound outputting device 101 is worn on the user.

The speaker 140 may output a sound. For example, when the sound outputting device 101 is used for talking, the speaker 140 may output a voice signal of the second speaker. The speaker 140 may be disposed at a center of the ear-tip 115.

The manipulator 145 may receive an input from the user. The manipulator 145 may be implemented as a physical button or a touch button. The sensor 146 may receive information about a state of the sound outputting device 101 or information about a surrounding object. For example, the sensor 146 may measure a heartbeat or an electrocardiogram of the user. The charging terminal 147 may receive an external power. A battery (not shown) inside the sound outputting device 101 may be charged using the power received via the charging terminal 147, FIG. 3 is a flow chart illustrating a sound processing method according to certain embodiments.

Figure 3:
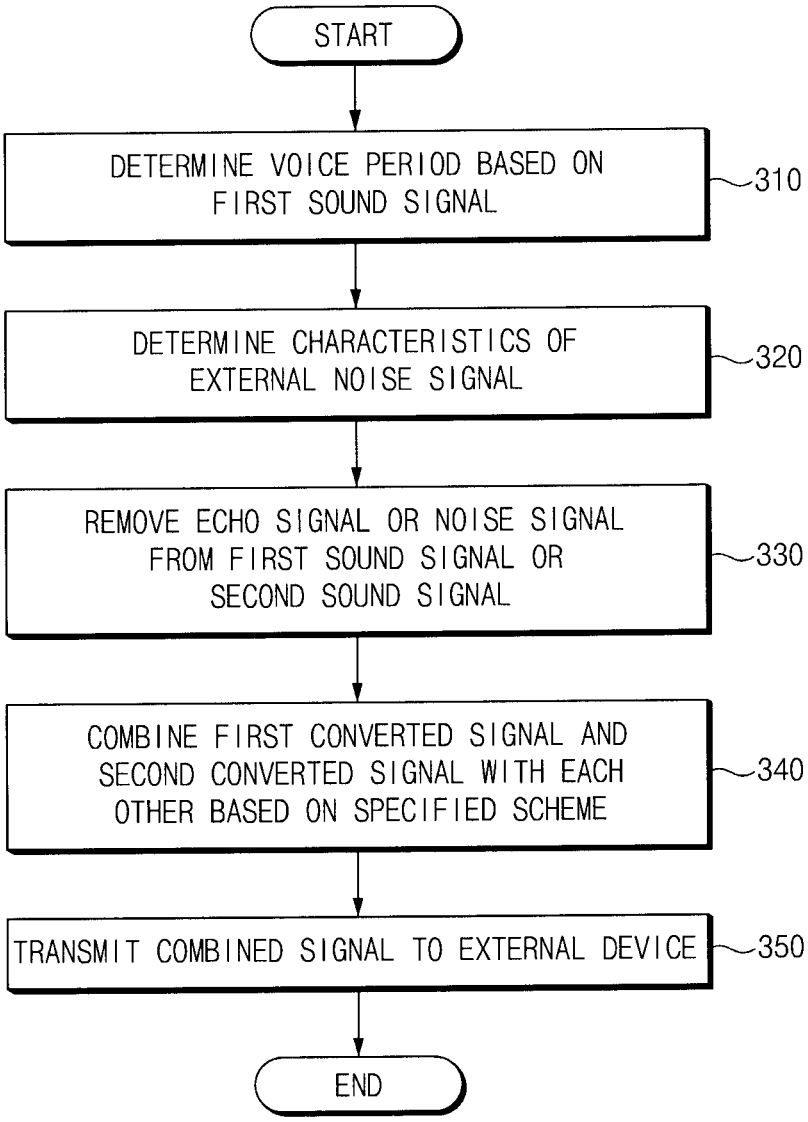
FIG. 3 is a flow chart illustrating a sound processing method according to certain embodiments.

Referring to FIG. 3, in operation 310, the processor 160 may determine whether a voice period is detected. A voice period indicates a time period during which a voice of the first speaker or the second speaker is present in a first sound signal received by the first microphone 120.

According to an embodiment, the processor 160 may distinguish between the voice period and a "silent period," meaning a period of time free of any voice inputs, based on the first sound signal. Again, the silent period may be a time period in which neither the first speaker nor the second speaker are speaking, and thus, no voice data is detected.

According to an embodiment, the processor 160 may classify the voice period as an only-speaking period, an only-listening period, or a cross-talk period. The processor 160 may pre-store sound characteristics of each of the periods and may match sound characteristics of the received first sound signal with the pre-stored sound characteristics and thus may distinguish between the only-speaking period, the only-listening period, and the cross-talk period based on the matching result. The processor 160 may perform different sound processing for the only-speaking period, the only-listening period, and the cross-talk period (see FIG. 5).

According to an embodiment, the processor 160 may distinguish the voice period, using a voice activity detection (VAD) scheme or a speech presence probability (SPP) scheme, based on the first sound signal. The first sound signal received via the first microphone 120 may include the sound or vibration transmitted through the inner ear tube or the body of the user and thus may be robust to an external noise signal (a noise around the first speaker or a noise around the sound outputting device 101). The first sound signal may be include a voice signal of the first speaker. When estimating the voice period using the first sound signal, an accuracy of the estimation using the VAD (voice activity detection) or the SPP (speech presence probability) may be improved.

In operation 320, the processor 160 may determine characteristics of the external noise signal based on the second sound signal received via the second microphone 130.

In an embodiment, the processor 160 may analyze the external noise signal by adaptively filtering the first sound signal received by the first microphone 120 from the second sound signal received by the second microphone 130.

According to another embodiment, the processor 160 may determine characteristics of the external noise signal for the silent period. The silent period may refer to a period for which the voice signal of the first speaker or the voice signal of the second speaker does not occur. The second sound signal received via the second microphone 120 as exposed outwardly for the silent period may be substantially the same as or similar to the external noise signal. The processor 160 may determine an entirety of the second sound signal as the external noise signal when a strength of the first sound signal is lower than or equal to a specified value.

According to certain embodiments, the processor 160 may classify a type of the external noise signal (e.g., non-stationary/stationary) and analyze characteristics thereof (e.g., the babble, the wind or the café noise).

In operation 330, the processor 160 may remove an echo (e.g., an echo signal) and noise (e.g., a noise signal) from the first sound signal or the second sound signal based on characteristics of the voice period and/or the determined characteristics of the external noise signal. That is, the "sound" of ambient or environmental noise may have been detected in operation 320, and accordingly, in operation 330, the same ambient/environment noise may be removed from other signals, leaving only desired signals in the recording, such as a user's voice signal. The echo signal may be an undesirable audio effect that occurs when the voice signal of the second speaker is output through the speaker of the sound outputting device 101 and then flows back into the first microphone 120 or the second microphone 130, which causes it to be output again (e.g., generating an echo of itself in a loop).

According to an embodiment, the processor 160 may remove the echo signal and the noise signal from the first sound signal, resulting in a filtered signal, and may extend the frequency band of the filtered signal to a specified frequency range, and/or further filter the filtered signal in a specified frequency band. The processor 160 may remove the external noise signal from the second sound signal.

In operation 340, the processor 160 may combine the first converted signal to which the first sound signal is converted, with the second converted signal to which from the second sound signal is converted, based on a prespecified scheme. According to an embodiment, the processor 160 may change the combining ratio between the first converted signal and the second converted signal, based on the characteristics of the external noise signal.

In operation 350, the processor 160 may transmit the combined signal to an external device. For example, the external device may be a mobile device paired with the sound outputting device 101. In another example, the external device may be a base station or a server that processes a voice call or a video call.

Figure 4:
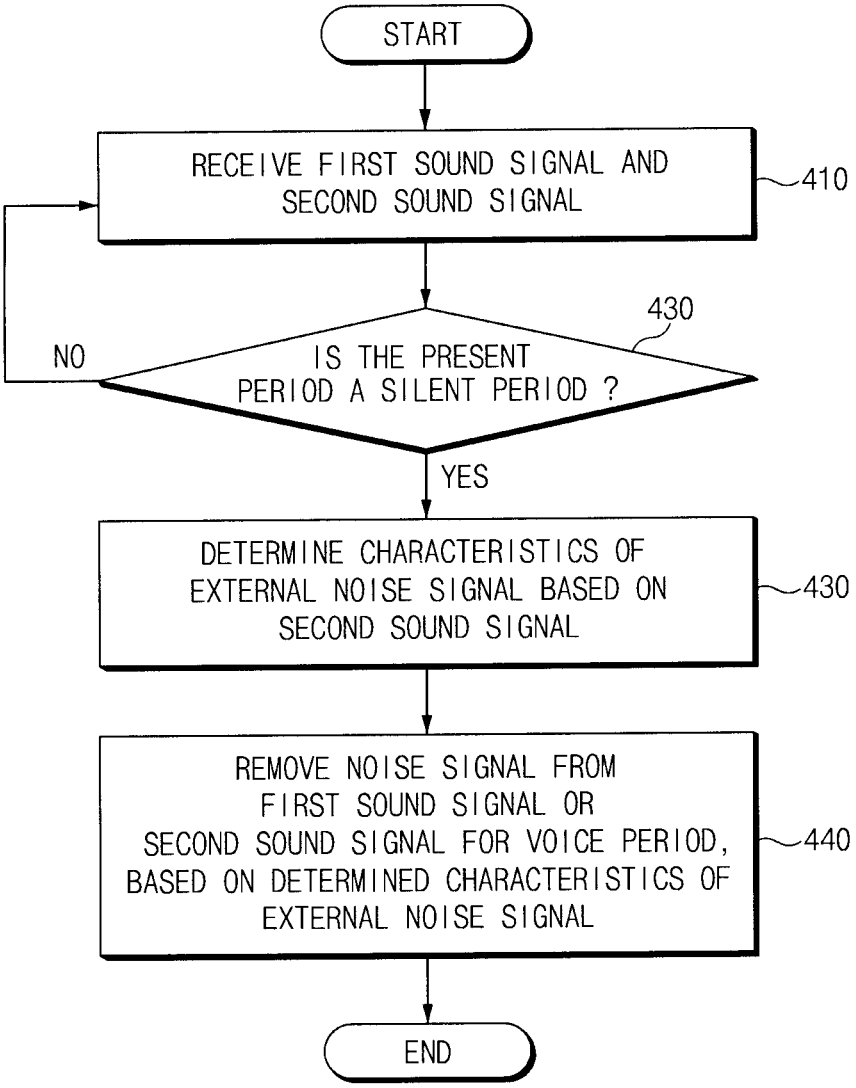
FIG. 4 shows a sound processing method for a silent period according to certain embodiments.

FIG. 4 shows a sound processing method for the silent period according to certain embodiments.

Referring to FIG. 4, in operation 410, the processor 160 may receive the first sound signal and the second sound signal. The first sound signal may be a signal received via the first microphone 120. The second sound signal may be a signal received via the second microphone 130.

In operation 430, the processor 160 may identify whether a current time is the silent period, based on the first sound signal received by the first microphone 120. For example, the processor 160 may compare the waveform, the magnitude, and the frequency component of the first sound signal with a prestored voice pattern, and determine the silent period when there is no corresponding matching pattern.

According to an embodiment, the processor 160 may distinguish the voice period using the voice activity detection (VAD) scheme or the speech presence probability (SPP) scheme. Otherwise, when the current time is not the voice period, the processor 160 may determine that the current time is the silent period.

In operation 430, for the silent period, the processor 160 may determine the characteristics of the external noise signal based on the second sound signal received via the second microphone 130. The second sound signal received for the silent period may be identical or substantially similar to the external noise signal.

In operation 440, the processor 160 may remove the noise from the first sound signal or the second sound signal for the voice period, based on the characteristics of the external noise signal determined for the silent period.

For example, when a "T1" time is determined to be in the silent period, the processor 160 may store information about the characteristics of the external noise signal at the T1 time. For the voice period after the T1 time, when a signal that matches the characteristics of the external noise is included in the first sound signal or the second sound signal, the processor 160 may remove the matching signal.

According to certain embodiments, a magnitude of the second sound signal received via the second microphone 120 as exposed outwardly for the silent period may be substantially the same as a magnitude of the external noise signal.

According to certain embodiments, the processor 160 may classify the external noise signal into a non-stationary signal and a stationary signal. When a signal to noise ratio (SNR) is inversely proportional to the magnitude of the noise, the processor 160 may determine the external noise signal as the stationary signal. When the external noise signal is the non-stationary signal, the processor 160 may classify a current sound, for example, as the babble, the wind, or the Café noise, based on a power of the first sound signal and an estimated SNR for the silent period.

According to certain embodiments, the processor 160 may determine the characteristics of the external noise signal using noise data received via a microphone installed in the external device (e.g., an adjacent base station). For example, when processor 160 receives a type, and intensity, or a SNR of the external noise signal from the adjacent base station, accuracy of analysis of a noise type in a specific place may be improved. The processor 160 may more accurately estimate the SPP (speech presence probability) or a power spectrum density (PSD) of a signal using a type and a magnitude of the noise as classified in detail, as compared to a conventional noise removing method using an external microphone (and sometimes excluding other receivers and listening devices). In this way, the processor 160 may more accurately perform the noise removal from the first sound signal and the second sound signal. Further, the accuracy of the VAD of the first microphone 120 may be increased. The processor 160 may more accurately perform adaptation to the noise environment received via the second microphone 130.

Figure 5:
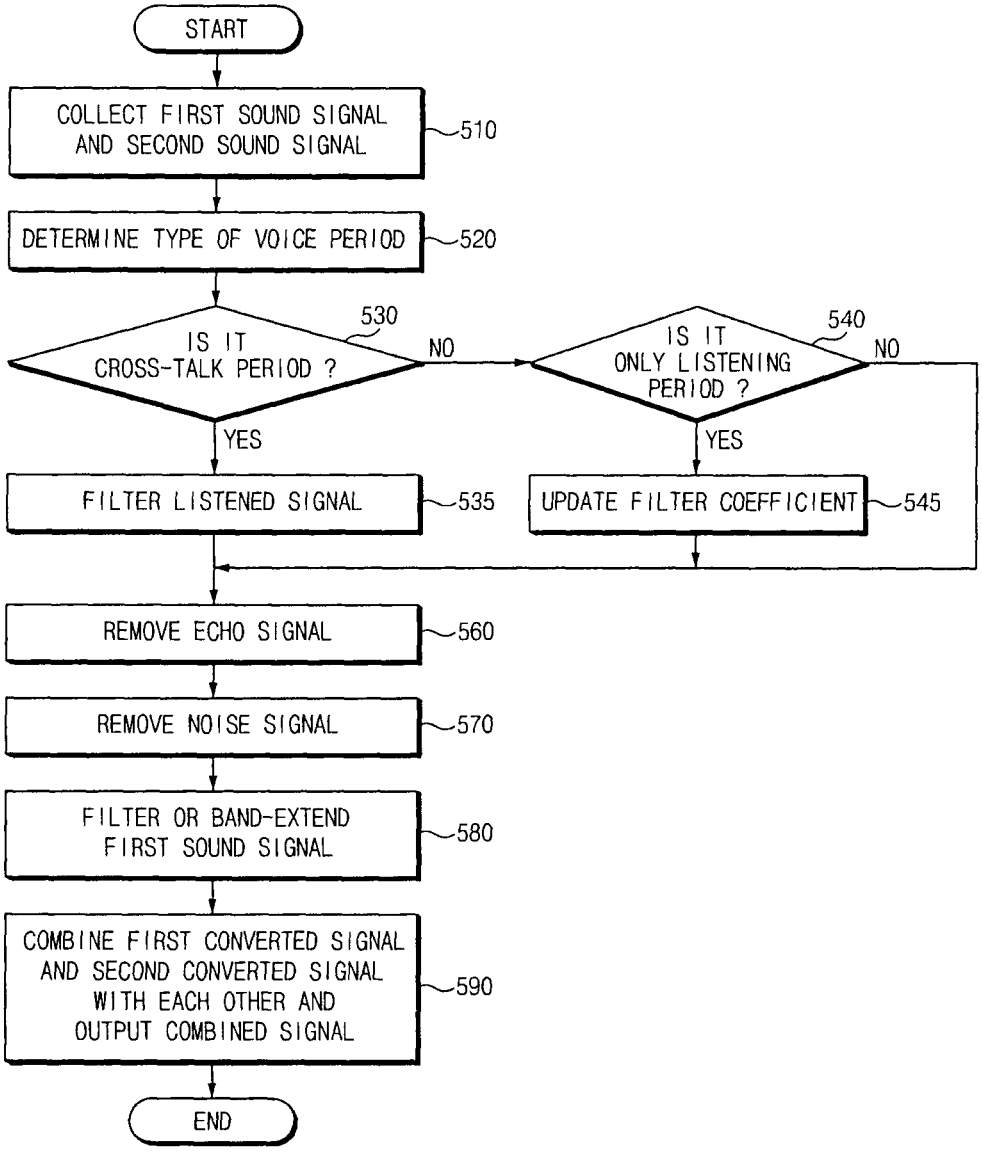
FIG. 5 shows a sound processing method for a voice period according to certain embodiments.

FIG. 5 shows a sound processing method for the voice period according to certain embodiments.

Referring to FIG. 5, in operation 510, the processor 160 may receive the first sound signal and the second sound signal. The first sound signal may be a signal received via the first microphone 120. The second sound signal may be a signal received via the second microphone 130.

In operation 520, the processor 160 may determine a type of the voice period based on the first sound signal received by the first microphone 120. According to an embodiment, the processor 160 may distinguish the voice period using the VAD (i.e., voice activity detection) scheme or the SPP (i.e., speech presence probability) scheme.

The processor 160 may classify the voice period as the cross-talk period, the only-speaking period or the only-listening period (as described above), based on presence or absence of speaking from the first speaker or speaking from the second speaker. For example, the processor 160 may compare the waveform, the magnitude, and the frequency component of the first sound signal with a prestored voice pattern of each of the periods. Then, the processor 160 may distinguish between the cross-talk period, the only-speaking period, and the only-listening period, based on the comparison result.

According to an embodiment, for the silent period, the processor 160 may use the second sound signal received via the second microphone 130 to estimate the external noise signal. The second sound signal received via the second microphone 130 exposed outwardly for the silent period may be substantially the same as or similar to the external noise signal.

In operation 530, the processor 160 may identify whether a current period is the cross-talk period. When the first sound signal simultaneously exhibits characteristics due to the speaking from the first speaker and characteristics due to the echo signal flowing in through the speaker 140, the processor 160 may identify that a current period is the cross-talk period.

In operation 535, for the cross-talk period, the processor 160 may filter and remove a speaking signal received from the second speaker. For example, the processor 160 may reduce a magnitude of the received speaking signal Rx or perform band-stop filtering thereof to reduce a magnitude of the echo signal to improve a performance of an echo remover. In this way, the processor 160 may lower a percentage of the speaking signal received from the second speaker as included in the first sound signal and may increase a percentage of the voice from the first speaker.

In operation 540, the processor 160 may identify whether a current period is the only-listening period. When the first sound signal does not include a voice pattern of the speaking from the first speaker but includes a voice pattern of the echo signal resulting from the speaking from the second speaker flowing in through the speaker 140, the processor 160 may determine that a current period is the only-listening period.

In operation 545, for the only-listening period, the processor 160 may adjust a filter coefficient for echo removal to increase a removal level of the echo signal.

According to certain embodiments, the first sound signal includes the voice pattern of the speaking from the first speaker and is free of the voice pattern of the echo signal flowing in through the speaker 140, the processor 160 may determine that a current period is the only-speaking period. For the only-speaking period, the processor 160 may adjust the filter coefficient for echo removal to lower the removal level of the echo signal or may not perform the echo removal.

In operation 560, the processor 160 may remove the echo signal from the first sound signal or the second sound signal. The processor 160 may remove the echo signal from the first sound signal or the second sound signal using an adaptive filtering scheme.

According to certain embodiments, the processor 160 may remove the echo signal based on filter coefficients set for the cross-talk period, the only-speaking period, and the only-listening period, respectively. For example, the processor 160 may increase the filter coefficient for the only-listening period and may decrease the filter coefficient for the only-speaking period.

In operation 570, the noise signal may be removed from the first sound signal and the second sound signal. The processor 160 may efficiently remove the noise based on presence or absence of a voice.

According to certain embodiments, the processor 160 may remove the noise signal from the first sound signal or the second sound signal based on the external noise signal analyzed for the silent period. The processor 160 may remove a pattern identical or similar to the external noise signal analyzed for the silent period from each of the first sound signal and the second sound signal.

In operation 580, filtering or band extension may be performed on the first sound signal. The first sound signal received via the first microphone 120 may refer to a signal of the voice of the first speaker transmitted via the external auditory meatus of the user. The first sound signal may be transmitted to the first microphone 120 via the body and the inner ear space of the user and may be robust against the external noise. Further, the first sound signal has characteristics that a sound pitch band thereof is limited to a low pitch band (e.g., 4 kHz or lower).

The processor 160 may perform the band extension on the first sound signal to partially correct a tone color. The first sound signal may be obtained by the first microphone 120 receiving the voice of the first speaker propagated inside the body which may have different frequency characteristics from those of a voice of the first speaker that is propagated in air. The processor 160 may filter or band-extend the first sound signal to alter the first sound signal to resemble the voice propagated in the air.

According to an embodiment, the processor 160 may estimate a source signal from the first sound signal received via the first microphone 120. For example, the processor 160 may add, to the first sound signal, a random noise instead of a high frequency component missing while the voice is passed to the first microphone 120, and may apply a voice filter estimated from the first sound signal thereto to extend the band thereof.

In operation 590, the processor 160 may combine the first converted signal (obtained by converting the first sound signal) with the second converted signal (obtained by converting the second sound signal), and output the combined signal. The processor 160 may linearly or nonlinearly combine the first converted signal and the second converted signal to create an output signal having a natural tone color.

The processor 160 may partially adjust frequency characteristics of the output signal via additional filtering. For example, the combining ratio between the first converted signal and the second converted signal may vary based on a noise environment. The processor 160 may create the output signal as linear and nonlinear combinations between the first converted signal and the second converted signal, based on magnitudes and types of the first converted signal and the second converted signal and a pre-estimated external noise signal.

Figure 6A:
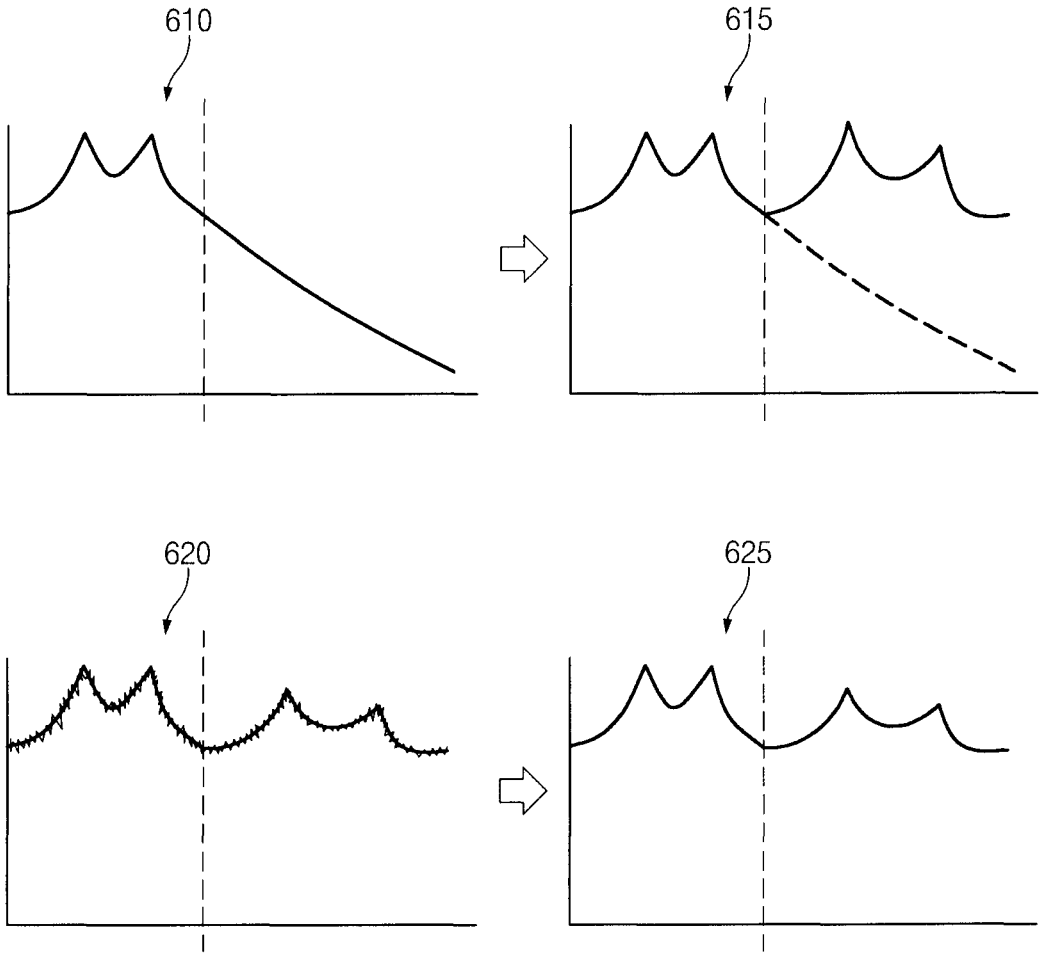
FIG. 6A shows band extending of a first sound signal according to certain embodiments.

FIG. 6A shows band extending of the first sound signal according to certain embodiments.

Referring to FIG. 6A, the processor 160 may receive a first sound signal 610 via the first microphone 120. Characteristics of the first sound signal 610 may vary based on characteristics of the first microphone 120, voice characteristics of the first speaker, or a communication environment.

According to certain embodiments, the first sound signal 610 may have a low frequency band (narrow band: NB) (e.g., a signal of 4 kHz or lower) characteristic. For example, the first sound signal 610 may be a narrow band signal having very few signals of 2 to 3 kHz or greater.

According to certain embodiments, the processor 160 may remove an echo signal by down-sampling a portion of the first sound signal 610 higher than a specified frequency (e.g., 4 kHz).

According to certain embodiments, the processor 160 may ADC (analog-to-digital convert) the first sound signal 610 to an NB (narrow band), or may ADC the first sound signal 610 to a WB (wide band) and then down sample the WB to the NB (narrow band). When the first sound signal 610 is changed to the narrow band (NB), the processor 160 may use less computing amount and memory usage than when the first sound signal 610 is processed via an echo remover or a noise remover.

According to certain embodiments, the processor 160 may receive a second sound signal 620 via the second microphone 130. The second sound signal 620 may have a higher percentage of an external noise signal than the first sound signal 610 has. Further, unlike the first sound signal 610, the second sound signal 620 may have characteristics of including both a low frequency band and a high frequency band.

According to certain embodiments, the processor 160 may create a first converted signal 615 via band extending of the first sound signal 610. The processor 160 may filter or band-extend the first sound signal 610 to create the first converted signal 615 similar to a voice propagated into the air. The first converted signal 615 may have the same or similar frequency characteristics as or to those of a second converted signal 625 obtained by removing an external noise signal from the second sound signal 620.

According to certain embodiments, the processor 160 may use the first converted signal 615 obtained by extending the band of the first sound signal 610 to estimate a power spectral density of the second sound signal 620, thereby to perform noise removal of the second sound signal 620 more accurately. Thus, the processor 160 may remove noises present between voice harmonics.

According to certain embodiments, the processor 160 may vary the combining ratio between the first converted signal 615 and the second converted signal 625 based on characteristics of the noise environment.

For example, in a region lower than 500 Hz, the processor 160 may create the output signal using the first converted signal 615, without using the second converted signal 625.

In another example, the processor 160 may increase a percentage of the first converted signal 615 and lower a percentage of the second converted signal 625 in a high noise level environment. To the contrary, the processor 160 may reduce the percentage of the first converted signal 615 and increase the percentage of the second converted signal 625 in a low external noise level environment.

According to an embodiment, the processor 160 may set different combining ratios in low and high frequency bands. For example, in the low frequency band, the processor 160 may set the percentages of the first converted signal 615 and the second converted signal 625 to 30% and 70%, respectively. In the high frequency band, 160 may set the percentages of the first converted signal 615 and the second converted signal 625 to 70% and 30%, respectively.

Figure 6B:
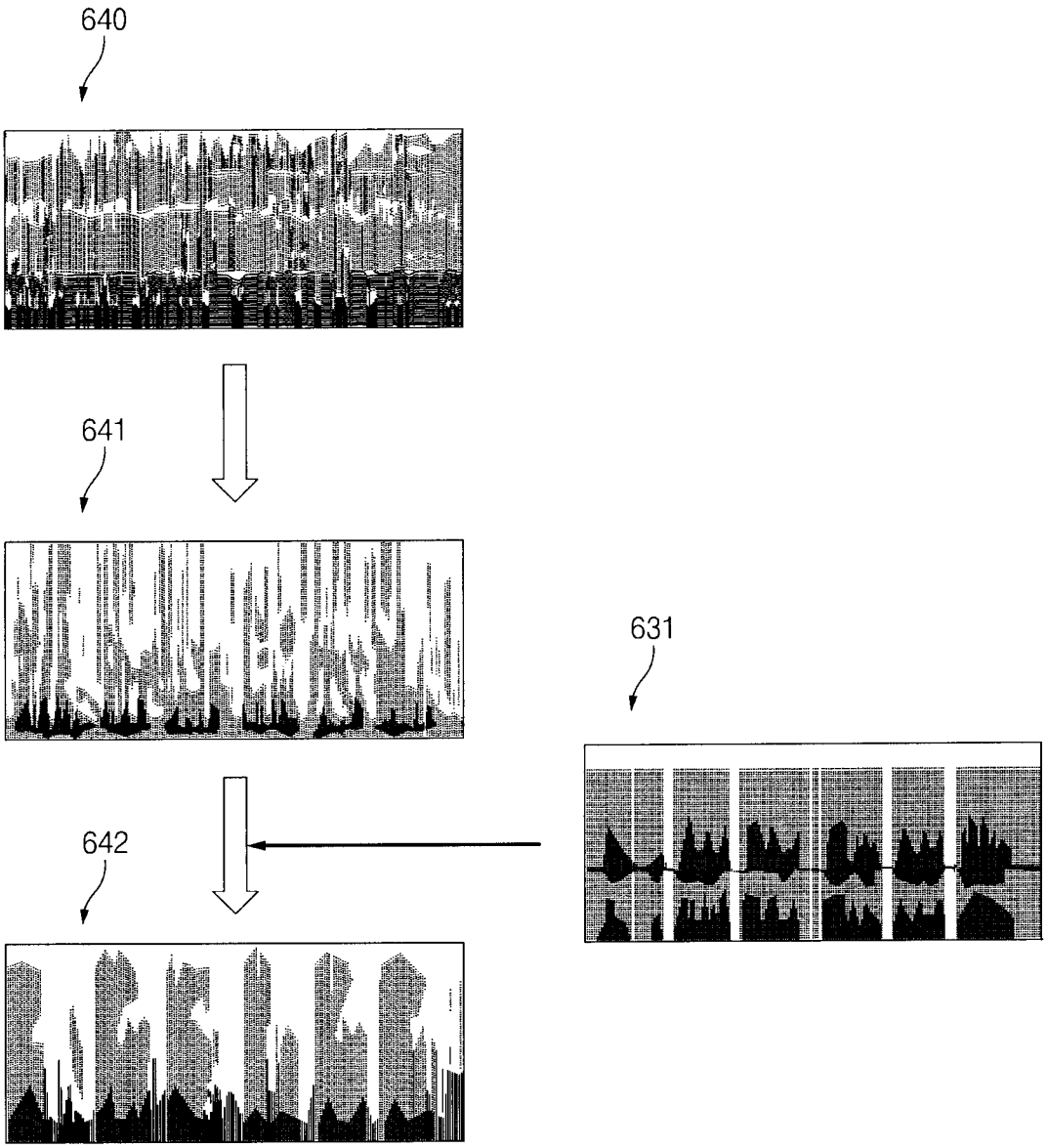
FIG. 6B shows a spectrogram for removing noise from a second sound signal using band extending of a first sound signal according to certain embodiments.

FIG. 6B shows a spectrogram (X-axis: a time, Y-axis: a frequency) to remove a noise from the second sound signal using the band extending of the first sound signal according to certain embodiments. FIG. 6B is illustrative and the disclosure is not limited thereto.

Referring to FIG. 6B, the processor 160 may receive a second sound signal 640 via the second microphone 130. The processor 160 may create a signal 641 obtained by first removing a noise from the second sound signal 640 via a noise removal algorithm. The noise removal algorithm may be a noise removal algorithm that is not related to the first sound signal received by the first microphone 120.

According to certain embodiments, the processor 160 may create a signal 631 by extending a band of the first sound signal. The processor 160 may create a signal 642 obtained by second removing a noise from the signal 641 based on the signal 631. According to an embodiment, the processor 160 may reflect an initial SPP value estimated from the signal 631 obtained by band-extending the first sound signal to create the signal 642.

Figure 6C:
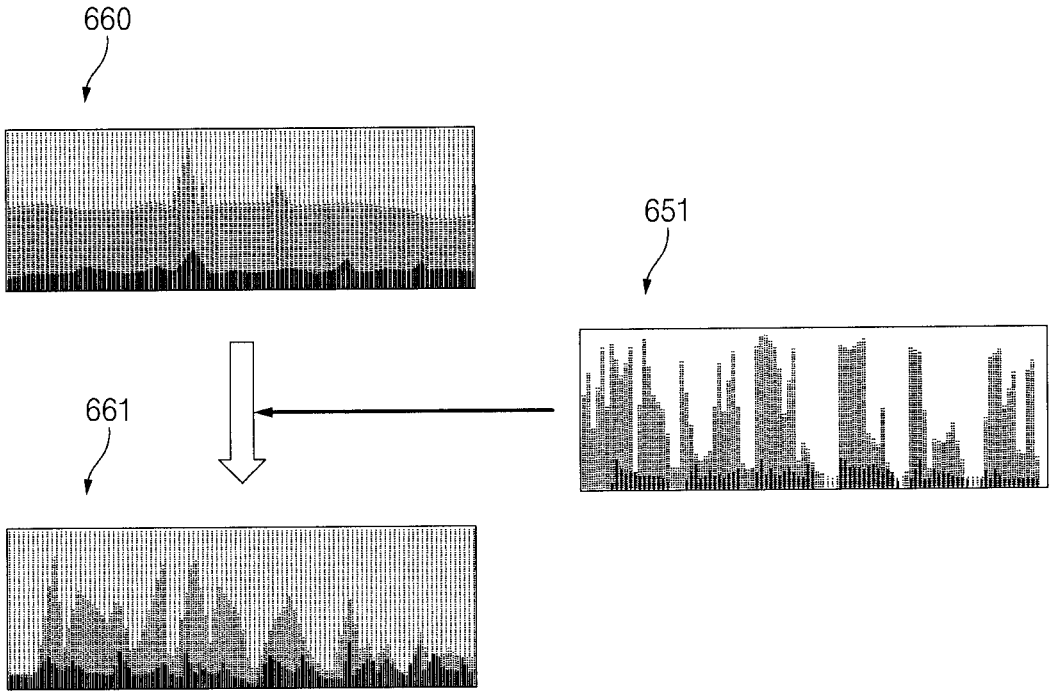
FIG. 6C shows a spectrogram for removing noise from a second sound signal using a fundamental frequency of a first sound signal according to certain embodiments.

FIG. 6C shows a spectrogram (X-axis: a time, Y-axis: a frequency) to remove a noise from the second sound signal using a fundamental frequency of the first sound signal according to certain embodiments. FIG. 6*c* is illustrative and the disclosure is not limited thereto.

Referring to FIG. 6C, the processor 160 may receive a second sound signal 660 via the second microphone 130.

According to certain embodiments, the processor 160 may detect a fundamental frequency 651 from the first sound signal and may estimate harmonics for the fundamental frequency as the initial SPP value. Thus, the estimated harmonics may be used to create a signal 661 in which a noise is removed.

The processor 160 may determine a portion (harmonics) of the first sound signal where a voice is likely to exist and may remove a noise from the portion.

Figure 7:
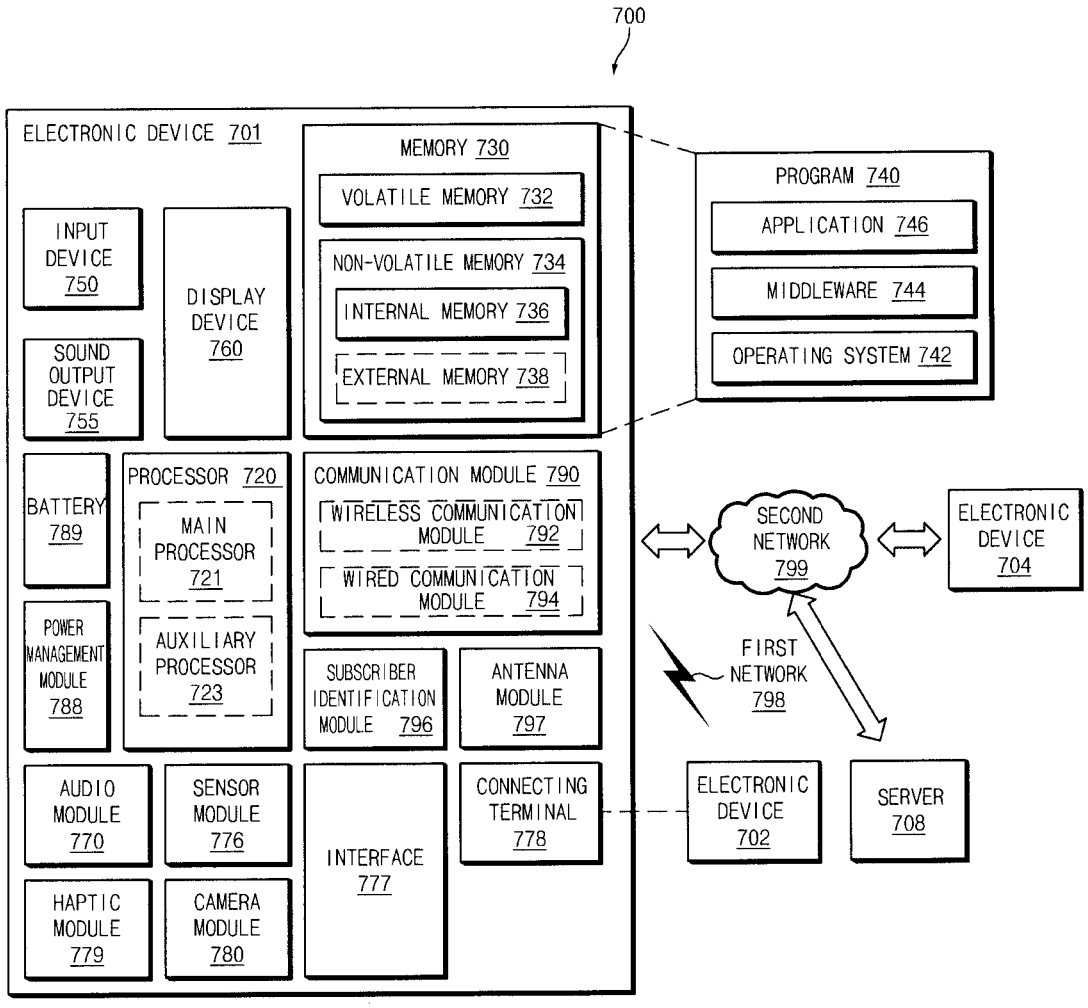
FIG. 7 shows a block diagram of an electronic device in a network environment according to certain embodiments.

FIG. 7 is a block diagram of an electronic device 701 in a network environment 700 according to certain embodiments. Electronic devices according to certain embodiments disclosed in the disclosure may be various types of devices. An electronic device may include at least one of, for example, a portable communication device (e.g., a smartphone, a computer device (e.g., a PDA: personal digital assistant), a tablet PC, a laptop PC, a desktop PC, a workstation, or a server), a portable multimedia device (e.g., e-book reader or MP3 player), a portable medical device (e.g., heart rate, blood sugar, blood pressure, or body temperature measuring device), a camera, or a wearable device. The wearable device may include at least one of an accessory type device (e.g., watches, rings, bracelets, anklets, necklaces, glasses, contact lenses, or head wearable device head-mounted-device (HMD)), a fabric or clothing integral device (e.g., an electronic clothing), a body-attached device (e.g., skin pads or tattoos), or an bio implantable circuit. In some embodiments, the electronic device may include at least one of, for example, a television, a DVD (digital video disk) player, an audio device, an audio accessory device (e.g., a speaker, headphones, or a headset), a refrigerator, an air conditioner, a cleaner, an oven, a microwave oven, a washing machine, an air purifier, a set top box, a home automation control panel, a security control panel, a game console, an electronic dictionary, an electronic key, a camcorder, or an electronic picture frame.

In another embodiment, the electronic device may include at least one of a navigation device, GNSS (global navigation satellite system), an EDR (event data recorder (e.g., black box for vehicle/ship/airplane), an automotive infotainment device (e.g., vehicle head-up display), an industrial or home robot, a drone, ATM (automated teller machine), a POS (point of sales) instrument, a measurement instrument (e.g., water, electricity, or gas measurement equipment), or an Internet of Things device (e.g. bulb, sprinkler device, fire alarm, temperature regulator, or street light). The electronic device according to the embodiment of the disclosure is not limited to the above-described devices. Further, for example, as in a smart phone equipped with measurement of biometric information (e.g., a heart rate or blood glucose) of an individual, the electronic device may have a combination of functions of a plurality of devices. In the disclosure, the term "user" may refer to a person using the electronic device or a device (e.g., an artificial intelligence electronic device) using the electronic device.

Referring to FIG. 7, in a network environment 700, an electronic device 701 communicates with an electronic device 702 through a short range wireless communication via the first network 798, or an electronic device 704 or a server 708 through a network 799. According to an embodiment of the present disclosure, the electronic device 701 may communicate with the electronic device 704 through the server 708.

FIG. 7 is a block diagram of the electronic device 701 in the network environment 700 according to certain embodiments. Referring to FIG. 7, the electronic device 701 may communicate with an electronic device 702 through a first network 798 (e.g., a short-range wireless communication network) or may communicate with an electronic device 704 or a server 708 through a second network 799 (e.g., a long-distance wireless communication network) in the network environment 700. According to an embodiment, the electronic device 701 may communicate with the electronic device 704 through the server 708. According to an embodiment, the electronic device 701 may include a processor 720, a memory 730, an input device 750, a sound output device 755, a display device 760, an audio module 770, a sensor module 776, an interface 777, a haptic module 779, a camera module 780, a power management module 788, a battery 789, a communication module 790, a subscriber identification module 796, or an antenna module 797. According to some embodiments, at least one (e.g., the display device 760 or the camera module 780) among components of the electronic device 701 may be omitted or one or more other components may be added to the electronic device 701. According to some embodiments, some of the above components may be implemented with one integrated circuit. For example, the sensor module 776 (e.g., a fingerprint sensor, an iris sensor, or an illuminance sensor) may be embedded in the display device 760 (e.g., a display).

The processor 720 may execute, for example, software (e.g., a program 740) to control at least one of other components (e.g., a hardware or software component) of the electronic device 701 connected to the processor 720 and may process or compute a variety of data. According to an embodiment, as a part of data processing or operation, the processor 720 may load a command set or data, which is received from other components (e.g., the sensor module 776 or the communication module 790), into a volatile memory 732, may process the command or data loaded into the volatile memory 732, and may store result data into a nonvolatile memory 734. According to an embodiment, the processor 720 may include a main processor 721 (e.g., a central processing unit or an application processor) and an auxiliary processor 723 (e.g., a graphic processing device, an image signal processor, a sensor hub processor, or a communication processor), which operates independently from the main processor 721 or with the main processor 721. Additionally or alternatively, the auxiliary processor 723 may use less power than the main processor 721, or is specified to a designated function. The auxiliary processor 723 may be implemented separately from the main processor 721 or as a part thereof.

The auxiliary processor 723 may control, for example, at least some of functions or states associated with at least one component (e.g., the display device 760, the sensor module 776, or the communication module 790) among the components of the electronic device 701 instead of the main processor 721 while the main processor 721 is in an inactive (e.g., sleep) state or together with the main processor 721 while the main processor 721 is in an active (e.g., an application execution) state. According to an embodiment, the auxiliary processor 723 (e.g., the image signal processor or the communication processor) may be implemented as a part of another component (e.g., the camera module 780 or the communication module 790) that is functionally related to the auxiliary processor 723.

The memory 730 may store a variety of data used by at least one component (e.g., the processor 720 or the sensor module 776) of the electronic device 701. For example, data may include software (e.g., the program 740) and input data or output data with respect to commands associated with the software. The memory 730 may include the volatile memory 732 or the nonvolatile memory 734.

The program 740 may be stored in the memory 730 as software and may include, for example, an operating system 742, a middleware 744, or an application 746.

The input device 750 may receive a command or data, which is used for a component (e.g., the processor 720) of the electronic device 701, from an outside (e.g., a user) of the electronic device 701. The input device 750 may include, for example, a microphone, a mouse, a keyboard, or a digital pen (e.g., a stylus pen).

The sound output device 755 may output a sound signal to the outside of the electronic device 701. The sound output device 755 may include, for example, a speaker or a receiver. The speaker may be used for general purposes, such as multimedia play or recordings play, and the receiver may be used for receiving calls. According to an embodiment, the receiver and the speaker may be either integrally or separately implemented.

The display device 760 may visually provide information to the outside (e.g., the user) of the electronic device 701. For example, the display device 760 may include a display, a hologram device, or a projector and a control circuit for controlling a corresponding device. According to an embodiment, the display device 760 may include a touch circuitry configured to sense the touch or a sensor circuit (e.g., a pressure sensor) for measuring an intensity of pressure on the touch.

The audio module 770 may convert a sound and an electrical signal in dual directions. According to an embodiment, the audio module 770 may obtain the sound through the input device 750 or may output the sound through the sound output device 755 or an external electronic device (e.g., the electronic device 702 (e.g., a speaker or a headphone)) directly or wirelessly connected to the electronic device 701.

The sensor module 776 may generate an electrical signal or a data value corresponding to an operating state (e.g., power or temperature) inside or an environmental state (e.g., a user state) outside the electronic device 701. According to an embodiment, the sensor module 776 may include, for example, a gesture sensor, a gyro sensor, a barometric pressure sensor, a magnetic sensor, an acceleration sensor, a grip sensor, a proximity sensor, a color sensor, an infrared sensor, a biometric sensor, a temperature sensor, a humidity sensor, or an illuminance sensor.

The interface 777 may support one or more designated protocols to allow the electronic device 701 to connect directly or wirelessly to the external electronic device (e.g., the electronic device 702). According to an embodiment, the interface 777 may include, for example, an HDMI (high-definition multimedia interface), a USB (universal serial bus) interface, an SD card interface, or an audio interface.

A connecting terminal 778 may include a connector that physically connects the electronic device 701 to the external electronic device (e.g., the electronic device 702). According to an embodiment, the connecting terminal 778 may include, for example, an HDMI connector, a USB connector, an SD card connector, or an audio connector (e.g., a headphone connector).

The haptic module 779 may convert an electrical signal to a mechanical stimulation (e.g., vibration or movement) or an electrical stimulation perceived by the user through tactile or kinesthetic sensations. According to an embodiment, the haptic module 779 may include, for example, a motor, a piezoelectric element, or an electric stimulator.

The camera module 780 may shoot a still image or a video image. According to an embodiment, the camera module 780 may include, for example, at least one or more lenses, image sensors, image signal processors, or flashes.

The power management module 788 may manage power supplied to the electronic device 701. According to an embodiment, the power management module 788 may be implemented as at least a part of a power management integrated circuit (PMIC).

The battery 789 may supply power to at least one component of the electronic device 701. According to an embodiment, the battery 789 may include, for example, a non-rechargeable (primary) battery, a rechargeable (secondary) battery, or a fuel cell.

The communication module 790 may establish a direct (e.g., wired) or wireless communication channel between the electronic device 701 and the external electronic device (e.g., the electronic device 702, the electronic device 704, or the server 708) and support communication execution through the established communication channel. The communication module 790 may include at least one communication processor operating independently from the processor 720 (e.g., the application processor) and supporting the direct (e.g., wired) communication or the wireless communication. According to an embodiment, the communication module 790 may include a wireless communication module 792 (e.g., a cellular communication module, a short-range wireless communication module, or a GNSS (global navigation satellite system) communication module) or a wired communication module 794 (e.g., an LAN (local area network) communication module or a power line communication module). The corresponding communication module among the above communication modules may communicate with the external electronic device 704 through the first network 798 (e.g., the short-range communication network such as a Bluetooth, a WiFi direct, or an IrDA (infrared data association)) or the second network 799 (e.g., the long-distance wireless communication network such as a cellular network, an internet, or a computer network (e.g., LAN or WAN)). The above-mentioned various communication modules may be implemented into one component (e.g., a single chip) or into separate components (e.g., chips), respectively. The wireless communication module 792 may identify and authenticate the electronic device 701 using user information (e.g., international mobile subscriber identity (IMSI)) stored in the subscriber identification module 796 in the communication network, such as the first network 798 or the second network 799.

The antenna module 797 may transmit or receive a signal or power to or from the outside (e.g., the external electronic device). According to an embodiment, the antenna module 797 may include an antenna including a radiating element implemented using a conductive material or a conductive pattern formed in or on a substrate (e.g., PCB). According to an embodiment, the antenna module 797 may include a plurality of antennas. In such a case, at least one antenna appropriate for a communication scheme used in the communication network, such as the first network 798 or the second network 799, may be selected, for example, by the communication module 790 from the plurality of antennas. The signal or the power may then be transmitted or received between the communication module 790 and the external electronic device via the selected at least one antenna. According to an embodiment, another component (e.g., a radio frequency integrated circuit (RFIC)) other than the radiating element may be additionally formed as part of the antenna module 797.

Figure 8:
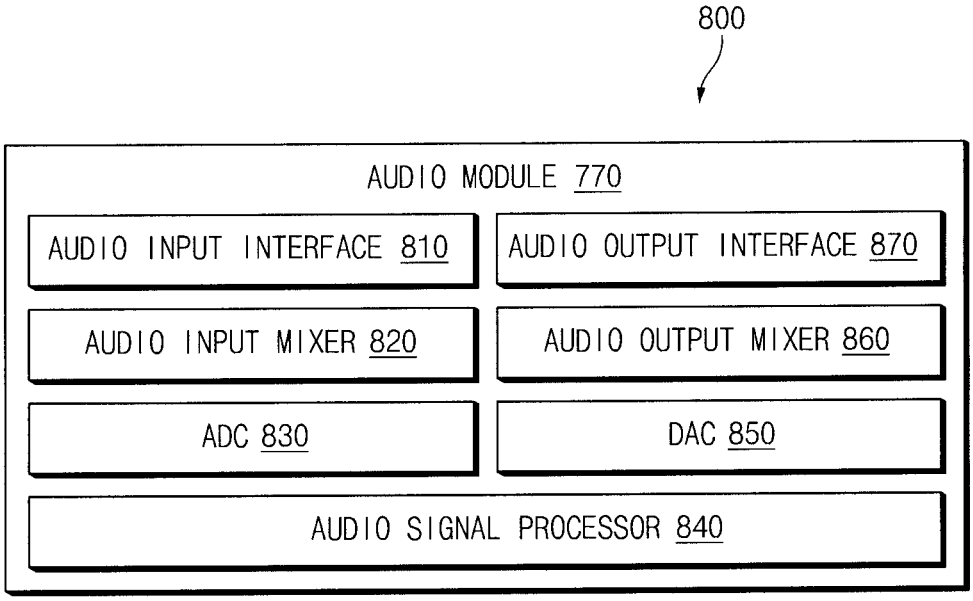
FIG. 8 is a block diagram of an audio module according to certain embodiments.

FIG. 8 is a block diagram 800 illustrating the audio module 770 according to certain embodiments. Referring to FIG. 8, the audio module 770 may include, for example, an audio input interface 810, an audio input mixer 820, an analog-to-digital converter (ADC) 830, an audio signal processor 840, a digital-to-analog converter (DAC) 850, an audio output mixer 860, or an audio output interface 870.

The audio input interface 810 may receive an audio signal corresponding to a sound obtained from the outside of the electronic device 701 via a microphone (e.g., a dynamic microphone, a condenser microphone, or a piezo microphone) that is configured as part of the input device 750 or separately from the electronic device 701. For example, if an audio signal is obtained from the external electronic device 702 (e.g., a headset or a microphone), the audio input interface 810 may be connected with the external electronic device 702 directly via the connecting terminal 778, or wirelessly (e.g., Bluetooth™ communication) via the wireless communication module 792 to receive the audio signal. According to an embodiment, the audio input interface 810 may receive a control signal (e.g., a volume adjustment signal received via an input button) related to the audio signal obtained from the external electronic device 702. The audio input interface 810 may include a plurality of audio input channels and may receive a different audio signal via a corresponding one of the plurality of audio input channels, respectively. According to an embodiment, additionally or alternatively, the audio input interface 810 may receive an audio signal from another component (e.g., the processor 720 or the memory 730) of the electronic device 701.

The audio input mixer 820 may synthesize a plurality of inputted audio signals into at least one audio signal. For example, according to an embodiment, the audio input mixer 820 may synthesize a plurality of analog audio signals inputted via the audio input interface 810 into at least one analog audio signal.

The ADC 830 may convert an analog audio signal into a digital audio signal. For example, according to an embodiment, the ADC 830 may convert an analog audio signal received via the audio input interface 810 or, additionally or alternatively, an analog audio signal synthesized via the audio input mixer 820 into a digital audio signal.

The audio signal processor 840 may perform various processing on a digital audio signal received via the ADC 830 or a digital audio signal received from another component of the electronic device 701. For example, according to an embodiment, the audio signal processor 840 may perform changing a sampling rate, applying one or more filters, interpolation processing, amplifying or attenuating a whole or partial frequency bandwidth, noise processing (e.g., attenuating noise or echoes), changing channels (e.g., switching between mono and stereo), mixing, or extracting a specified signal for one or more digital audio signals. According to an embodiment, one or more functions of the audio signal processor 840 may be implemented in the form of an equalizer.

The DAC 850 may convert a digital audio signal into an analog audio signal. For example, according to an embodiment, the DAC 850 may convert a digital audio signal processed by the audio signal processor 840 or a digital audio signal obtained from another component (e.g., the processor 720 or the memory 730) of the electronic device 701 into an analog audio signal.

The audio output mixer 860 may synthesize a plurality of audio signals, which are to be outputted, into at least one audio signal. For example, according to an embodiment, the audio output mixer 860 may synthesize an analog audio signal converted by the DAC 850 and another analog audio signal (e.g., an analog audio signal received via the audio input interface 810) into at least one analog audio signal.

The audio output interface 870 may output an analog audio signal converted by the DAC 850 or, additionally or alternatively, an analog audio signal synthesized by the audio output mixer 860 to the outside of the electronic device 701 via the sound output device 755. The sound output device 755 may include, for example, a speaker, such as a dynamic driver or a balanced armature driver, or a receiver. According to an embodiment, the sound output device 755 may include a plurality of speakers. In such a case, the audio output interface 870 may output audio signals having a plurality of different channels (e.g., stereo channels or 5.1 channels) via at least some of the plurality of speakers. According to an embodiment, the audio output interface 870 may be connected with the external electronic device 702 (e.g., an external speaker or a headset) directly via the connecting terminal 778 or wirelessly via the wireless communication module 792 to output an audio signal.

According to an embodiment, the audio module 770 may generate, without separately including the audio input mixer 820 or the audio output mixer 860, at least one digital audio signal by synthesizing a plurality of digital audio signals using at least one function of the audio signal processor 840.

According to an embodiment, the audio module 770 may include an audio amplifier (not shown) (e.g., a speaker amplifying circuit) that is capable of amplifying an analog audio signal inputted via the audio input interface 810 or an audio signal that is to be outputted via the audio output interface 870. According to an embodiment, the audio amplifier may be configured as a module separate from the audio module 770.

A sound outputting device (e.g., the sound outputting device 101 of FIG. 1) according to certain embodiments may include a housing, a first microphone mounted to face in a first direction of the housing, a second microphone mounted to face in a second direction of the housing, a memory, and a processor. The processor may determine a voice period based on a first sound signal received via the first microphone, for a silent period other than the voice period, determine characteristics of an external noise signal based on a second sound signal received via the second microphone, remove a noise signal from the first sound signal or the second sound signal, based on characteristics of the voice period or the characteristics of the external noise signal, combine the first sound signal and the second sound signal with each other based on a specified scheme to create a combined signal as an output signal, and transmit the output signal to an external device.

According to certain embodiments, the processor may remove an echo signal from the first sound signal or the second sound signal, based on the characteristics of the voice period or the characteristics of the external noise signal.

According to certain embodiments, the processor may classify the voice period as a cross-talk period, an only-speaking period, or an only-listening period.

According to certain embodiments, the processor may filter a speaking signal received from a counterpart speaker and contained in the first sound signal for the cross-talk period.

According to certain embodiments, the processor may update a filtering coefficient for removing an echo signal for the only-listening period.

According to certain embodiments, the processor may remove a pattern identical with or similar to the external noise signal from the first sound signal or the second sound signal.

According to certain embodiments, the processor may extend a frequency band of the first sound signal to a region higher than or equal to a specified frequency.

According to certain embodiments, the processor may add a random noise to the first sound signal.

According to certain embodiments, the processor may determine a combining ratio between the first sound signal and the second sound signal, based on the characteristics of the external noise signal.

According to certain embodiments, the processor may set different combining ratios between the first sound signal and the second sound signal in first and second frequency bands.

According to certain embodiments, the first microphone may be inserted into an inner ear space of a user and may be sealed in or may be in contact with a body of the user.

According to certain embodiments, when a portion of the sound outputting device is inserted into an inner ear space of a user, the second microphone may be placed closer to a mouth of the user than the first microphone is placed.

According to certain embodiments, the processor may determine the voice period of the first sound signal using a voice activity detection (VAD) scheme or a speech presence probability (SSP) scheme.

According to certain embodiments, the processor may determine the voice period based on at least one of a correlation between the first sound signal and the second sound signal or a difference between magnitudes of the first sound signal and the second sound signal.

According to certain embodiments, the processor may receive data about the external noise signal from an external device, and remove the noise signal from the first sound signal or the second sound signal based on the data.

According to certain embodiments, the processor may classify the external noise signal into stationary and non-stationary signals, and when the external noise signal is the non-stationary signal, compare the external noise signal with a noise pattern prestored in the memory to determine a type of the external noise signal based on the comparison result.

According to certain embodiments, the processor may remove a first noise not related to the first sound signal from the second sound signal, and, after the first noise removal, remove a second noise using the second sound signal.

According to certain embodiments, the memory may store instructions therein, and an operation of the processor may be configured via execution of the instructions.

According to certain embodiments, the processor may extract a fundamental frequency and harmonics for the fundamental frequency from the first sound signal, and remove a noise from the second sound signal using the fundamental frequency and the harmonics.

A sound processing method performed by a sound outputting device according to certain embodiments may include determining a voice period based on a first sound signal received via a first microphone mounted to face in a first direction, for a silent period other than the voice period, determining characteristics of an external noise signal based on a second sound signal received via a second microphone mounted to face in a second direction, removing a noise signal from the first sound signal or the second sound signal, based on characteristics of the voice period or the characteristics of the external noise signal, combining the first sound signal and the second sound signal with each other based on a specified scheme to create a combined signal as an output signal, and transmitting the output signal to an external device.

According to certain embodiments, the determining of the voice period may include classifying the voice period as a cross-talk period, an only-speaking period, or an only-listening period.

At least some components among the components may be connected to each other through a communication method (e.g., a bus, a GPIO (general purpose input and output), an SPI (serial peripheral interface), or an MIPI (mobile industry processor interface)) used between peripheral devices to exchange signals (e.g., a command or data) with each other.

According to an embodiment, the command or data may be transmitted or received between the electronic device 701 and the external electronic device 704 through the server 708 connected to the second network 799. Each of the electronic devices 702 and 704 may be the same or different types as or from the electronic device 701. According to an embodiment, all or some of the operations performed by the electronic device 701 may be performed by one or more external electronic devices among the external electronic devices 702, 704, or 708. For example, when the electronic device 701 performs some functions or services automatically or by request from a user or another device, the electronic device 701 may request one or more external electronic devices to perform at least some of the functions related to the functions or services, in addition to or instead of performing the functions or services by itself. The one or more external electronic devices receiving the request may carry out at least a part of the requested function or service or the additional function or service associated with the request and transmit the execution result to the electronic device 701. The electronic device 701 may provide the result as is or after additional processing as at least a part of the response to the request. To this end, for example, a cloud computing, distributed computing, or client-server computing technology may be used.

The electronic device according to certain embodiments disclosed in the disclosure may be various types of devices. The electronic device may include, for example, a portable communication device (e.g., a smartphone), a computer device, a portable multimedia device, a mobile medical appliance, a camera, a wearable device, or a home appliance. The electronic device according to an embodiment of the disclosure should not be limited to the above-mentioned devices.

It should be understood that certain embodiments of the disclosure and terms used in the embodiments do not intend to limit technical features disclosed in the disclosure to the particular embodiment disclosed herein; rather, the disclosure should be construed to cover various modifications, equivalents, or alternatives of embodiments of the disclosure. With regard to description of drawings, similar or related components may be assigned with similar reference numerals. As used herein, singular forms of noun corresponding to an item may include one or more items unless the context clearly indicates otherwise. In the disclosure disclosed herein, each of the expressions "A or B", "at least one of A and B", "at least one of A or B", "A, B, or C", "one or more of A, B, and C", or "one or more of A, B, or C", and the like used herein may include any and all combinations of one or more of the associated listed items. The expressions, such as "a first", "a second", "the first", or "the second", may be used merely for the purpose of distinguishing a component from the other components, but do not limit the corresponding components in other aspect (e.g., the importance or the order). It is to be understood that if an element (e.g., a first element) is referred to, with or without the term "operatively" or "communicatively", as "coupled with," "coupled to," "connected with," or "connected to" another element (e.g., a second element), it means that the element may be coupled with the other element directly (e.g., wiredly), wirelessly, or via a third element.

The term "module" used in the disclosure may include a unit implemented in hardware, software, or firmware and may be interchangeably used with the terms "logic", "logical block", "part" and "circuit". The "module" may be a minimum unit of an integrated part or may be a part thereof. The "module" may be a minimum unit for performing one or more functions or a part thereof. For example, according to an embodiment, the "module" may include an application-specific integrated circuit (ASIC).

Certain embodiments of the disclosure may be implemented by software (e.g., the program 740) including an instruction stored in a machine-readable storage medium (e.g., an internal memory 736 or an external memory 738) readable by a machine (e.g., the electronic device 701). For example, the processor (e.g., the processor 720) of a machine (e.g., the electronic device 701) may call the instruction from the machine-readable storage medium and execute the instructions thus called. This means that the machine may perform at least one function based on the called at least one instruction. The one or more instructions may include a code generated by a compiler or executable by an interpreter. The machine-readable storage medium may be provided in the form of non-transitory storage medium. Here, the term "non-transitory", as used herein, means that the storage medium is tangible, but does not include a signal (e.g., an electromagnetic wave). The term "non-transitory" does not differentiate a case where the data is permanently stored in the storage medium from a case where the data is temporally stored in the storage medium.

According to an embodiment, the method according to certain embodiments disclosed in the disclosure may be provided as a part of a computer program product. The computer program product may be traded between a seller and a buyer as a product. The computer program product may be distributed in the form of machine-readable storage medium (e.g., a compact disc read only memory (CD-ROM)) or may be directly distributed (e.g., download or upload) online through an application store (e.g., a Play Store™) or between two user devices (e.g., the smartphones). In the case of online distribution, at least a portion of the computer program product may be temporarily stored or generated in a machine-readable storage medium such as a memory of a manufacturer's server, an application store's server, or a relay server.

According to certain embodiments, each component (e.g., the module or the program) of the above-described components may include one or plural entities. According to certain embodiments, at least one or more components of the above components or operations may be omitted, or one or more components or operations may be added. Alternatively or additionally, some components (e.g., the module or the program) may be integrated in one component. In this case, the integrated component may perform the same or similar functions performed by each corresponding components prior to the integration. According to certain embodiments, operations performed by a module, a programming, or other components may be executed sequentially, in parallel, repeatedly, or in a heuristic method, or at least some operations may be executed in different sequences, omitted, or other operations may be added.

The electronic device according to the embodiments disclosed in the disclosure may transmit the user's voice clearly to the external device even in a high noise level environment and remove the echo of the listened voice using the signals received via the plurality of microphones.

The electronic device according to the embodiments disclosed in the disclosure may perform a voice call, a voice recognition, or a voice commands even in the high noise level environment using the signals received via the plurality of microphones.

In addition, various effects may be provided that are identified directly or indirectly based on the disclosure.

While the disclosure has been shown and described with reference to certain embodiments thereof, it will be understood by those skilled in the art that various changes in form and details may be made therein without departing from the disclosure as defined by the appended claims and their equivalents.

What is claimed is:

1. An electronic device comprising:

a first microphone disposed to face a first direction;

a second microphone disposed to face a second direction;

a memory storing instructions; and a processor, wherein the instructions are executable by the processor to cause the electronic device to:

determine whether a voice is detected in a first sound signal received via the first microphone;

when the voice is detected, determine that a present recording period is a voice period, and when the voice is undetected, determine that the present recording period is a silent period;

receive a second sound signal via the second microphone;

detect characteristics of an external noise signal included in the second sound signal in the silent period;

remove noise signals from at least one of the first sound signal and the second sound signal, based on characteristics of the voice or the characteristics of the external noise signal;

generate an output signal by combining the first sound signal and the second sound signal from which the noise signals have been removed; and transmit the output signal to an external device, wherein the voice period is further classified as one of:

a first period in which a voice of a speaker of the electronic device and a voice of a counterpart speaker are detected in the first sound signal:

a second period in which the voice of the speaker is detected in absence of the voice of the counterpart speaker in the first sound signal; and a third period in which the voice of the counterpart speaker is detected in absence of the voice of the speaker in the first sound signal.

2. The electronic device of claim 1, wherein the instructions are further executable by the processor to cause the electronic device to:

remove an echo signal from the first sound signal or the second sound signal, based on the characteristics of the voice period or the characteristics of the external noise signal.

3. The electronic device of claim 1, wherein, when the voice period is classified as the first period, the instructions are further executable by the processor to cause the electronic device to:

filter the first sound signal to remove an echo.

4. The electronic device of claim 1, wherein where the voice period is classified as the third period, the instructions are further executable by the processor to cause the electronic device to: update a filtering coefficient to remove an echo from the first sound signal.

5. The electronic device of claim 1, wherein the noise signal is removed from the first sound signal and the second sound signal when the noise signal matches the characteristics of the external noise signal by a predetermined similarity threshold.

6. The electronic device of claim 1, wherein the instructions are executable by the processor to cause the electronic device to:

change a frequency band of the first sound signal from a first frequency band to a second frequency band that is higher than or equal to a prespecified frequency.

7. The electronic device of claim 6, wherein instructions are executable by the processor to cause the electronic device to: add a random noise to the first sound signal.

8. The electronic device of claim 1, wherein the instructions are executable by the processor to cause the electronic device to: determine a combining ratio for controlling combination of the first sound signal and the second sound signal, based on the characteristics of the external noise signal.

9. The electronic device of claim 8, wherein the instructions are executable by the processor to cause the electronic device to:

set a first combining ratio for controlling the combination of the first and second sound signals in a first frequency band, and set a second combining ratio different from the first combining ratio for controlling the combination of the first and second sound signals in a second frequency band separate from the first frequency band.

10. The electronic device of claim 1, wherein the first microphone is insertable into an inner ear space of a user.

11. The electronic device of claim 1, wherein the first microphone and the second microphone are arranged such that when the electronic device is at least partially inserted into an inner ear space of a user, the second microphone is nearer to a mouth of the user than the first microphone.

12. The electronic device of claim 1, wherein the voice period of the first sound signal is determined using a voice activity detection (VAD) scheme or a speech presence probability (SSP) scheme.

13. The electronic device of claim 1, wherein the voice period is determined based on at least one of a correlation between the first sound signal and the second sound signal, and a difference in magnitude between the first sound signal and the second sound signal.

14. The electronic device of claim 1, wherein the instructions are executable by the processor to cause the electronic device to:

receive data associated with the external noise signal from the external device, and wherein the noise signals are removed from the first sound signal or the second sound signal based on the received data.

15. The electronic device of claim 1, wherein the instructions are executable by the processor to cause the electronic device to:

classify the external noise signal into stationary and non-stationary signals; and when the external noise signal is the non-stationary signal, compare the external noise signal with a noise pattern prestored in the memory to determine a type of the external noise signal based on a result of the comparison.

16. The electronic device of claim 1, wherein the instructions are executable by the processor to cause the electronic device to:

remove a first noise unrelated to the first sound signal from the second sound signal; and after removing the first noise, remove a second noise from the second sound signal.

17. The electronic device of claim 1, wherein the instructions are executable by the processor to cause the electronic device to:

extract a fundamental frequency from the first sound signal, and extract harmonics for the extracted fundamental frequency from the first sound signal, wherein the noise signals are removed from the second sound signal based in part on the fundamental frequency.

18. A method in an electronic device, the method comprising:

determining by a processor whether a voice is detected in a first sound signal received via a first microphone;

when the voice is detected, determining that a present recording period is a voice period, and when the voice is undetected, determining that the present recording period is a silent period;

receiving a second sound signal via a second microphone;

detecting characteristics of an external noise signal included in the second sound signal in the silent period;

removing noise signals from at least one of the first sound signal and the second sound signal, based on characteristics of the voice or the characteristics of the external noise signal;

generating an output signal by combining the first sound signal and the second sound signal from which the noise signals have been removed; and transmitting the output signal to an external device, wherein the voice period is further classified as one of:

a first period in which a voice of a speaker of the electronic device and a voice of a counterpart speaker are detected in the first sound signal:

a second period in which the voice of the speaker is detected in absence of the voice of the counterpart speaker in the first sound signal; and a third period in which the voice of the counterpart speaker is detected in absence of the voice of the speaker in the first sound signal.

* * * * *